United States Patent [19]

Siebert

[11] 4,143,934

[45] Mar. 13, 1979

[54] SOCKET AND PLUG HOLDER

[76] Inventor: Howard L. Siebert, 48 Humboldt Pkwy., Williams Bay, Wis. 53191

[21] Appl. No.: 862,867

[22] Filed: Dec. 21, 1977

[51] Int. Cl.[2] ..... H01R 13/54; H01R 13/58

[52] U.S. Cl. ..... 339/75 P; 339/107

[58] Field of Search ..... 339/75 P, 39, 44 R, 339/107, 255 L, 273 R, 279

[56] References Cited

U.S. PATENT DOCUMENTS

| | | | |
|---|---|---|---|
| 2,166,458 | 7/1939 | Berndt et al. | 339/255 L |
| 2,590,886 | 4/1952 | Pedersen | 339/107 |
| 3,030,601 | 4/1962 | Krebs | 339/107 X |
| 3,569,914 | 3/1971 | Taylor et al. | 339/107 |
| 3,999,828 | 12/1976 | Howell | 339/75 P |

*Primary Examiner*—Roy Lake
*Assistant Examiner*—E. F. Desmond
*Attorney, Agent, or Firm*—Allegretti, Newitt, Witcoff & McAndrews

[57] ABSTRACT

A holder for retaining an electrical connection between two electrical power cords includes a hinged housing defining two openings for the cords. A flexible jaw member is integrally molded on the housing adjacent each of the openings and opposite an integrally molded rigid jaw member, and an eccentric member is pivotally mounted adjacent each jaw member. When the cam members are manually rotated, the flexible jaw members are thereby flexed to clamp the cords against the rigid jaw members.

6 Claims, 4 Drawing Figures

SOCKET AND PLUG HOLDER

BACKGROUND OF THE INVENTION

This invention relates to a holder for retaining an electrical connection between a socket and a plug of two electrical power cords.

In the past, a variety of devices for holding sockets and plugs together have been disclosed in U.S. Patents. Among these patents are: U.S. Pat. No. 1,454,858 issued May 15, 1923 and entitled "Connection Plug"; U.S. Pat. No. 1,874,334 issued Aug. 30, 1932 and entitled "Locking Means for Separable Electric Fittings"; U.S. Pat. No. 2,284,945 issued June 2, 1942 and entitled "Cable Connector"; U.S. Pat. No. 2,680,145 issued June 1, 1954 and entitled "Wire Connector"; U.S. Pat. No. 2,725,543 issued Nov. 29, 1955 and entitled "Coupling for Electrical Plug Connectors"; U.S. Pat. No. 2,753,536 issued July 3, 1956 and entitled "Clamps for Holding Electric Connectors Together"; U.S. Pat. No. 2,984,815 issued May 16, 1961 and entitled "Clamping Device for Electrical Extension Cord Couplings"; U.S. Pat. No. 3,014,194 issued Dec. 19, 1961 and entitled "Cable Connector Protector"; U.S. Pat. No. 3,030,601 issued Apr. 17, 1962 and entitled "Electric Cord Connector"; U.S. Pat. No. 3,048,810 issued Aug. 7, 1962 and entitled "Coupling For Conductor Cord Plugs"; U.S. Pat. No. 3,059,209 issued Oct. 16, 1962 and entitled "Cap For Electrical Plug Connections"; U.S. Pat. No. 3,223,958 issued Dec. 14, 1965 and entitled "Clamp For Extension Cords"; U.S. Pat. No. 3,344,393 issued Sept. 26, 1967 and entitled "Connector Housing"; U.S. Pat. No. 3,613,046 issued Oct. 12, 1971 and entitled "Biasing Electrical Coupling Holder"; and U.S. Pat. No. 3,659,248 issued Apr. 25, 1972 and entitled "Combined Socket Cover and Plug Retainer."

From a study of the listed patents, it should be apparent that a variety of devices for holding plugs and sockets together have been designed. Nevertheless, it is believed that each of these devices has certain limitations and disadvantages that restrict their desirability. First a number of the devices grip the plug and the socket rather than the cords, thus increasing the tendency of some plugs and sockets to separate from their cords. Second, many of the devices are designed for use with sockets and plugs of only one size and shape, and they are not useful with other sockets and plugs. Third, many of the devices are mechanically complicated, requiring the assembly of various stamped metal, wire and formed rubber components. Fourth, most are relatively expensive to produce, for the same reason that they are complicated.

SUMMARY OF THE INVENTION

In contrast with the devices disclosed in the above-listed patents, it is an object of the present invention to provide an improved socket and plug holder without the limitations and disadvantages of these devices.

Specifically, it is an object of the present invention to provide an improved socket and plug holder which grips the cords attached to the socket and plug, not the socket and plug themselves.

It is another object of the present invention to provide a socket and plug holder which may be used with a variety of sizes and shapes of sockets and plugs.

A further object of the present invention is to provide a socket and plug holder which can be mass-produced at a commercially acceptable cost.

A still further object of the present invention is to provide a socket and plug holder which is readily molded from plastic, having no parts made of metal, rubber or other non-plastic material.

Thus, in a principal aspect, the present invention is a holder for maintaining an electrical connection between a socket of a first electrical cord and a plug of a second electrical cord, comprising a housing having a lower section and an upper section hingedly attached thereto, said upper section and lower section defining a space for receiving the plug and socket and further defining two openings into the space for passage of the cords; a rigid jaw member integrally molded on the housing adjacent one of the openings; a flexible jaw member integrally molded on the housing adjacent the one opening and opposite the rigid jaw member, the flexible jaw member adapted to flex to a flexed position wherein one of the cords is clamped against movement between the flexible jaw member and the rigid jaw member; and an eccentric cam member pivotably mounted on the housing adjacent the flexible jaw member on the side thereof opposite the one opening, the cam member being pivotable to pivoted position wherein the cam member forces the flexible jaw member to said flexed position; whereby the one cord is clamped against movement and the electrical connection between the socket and plug is maintained against tension in the one cord.

BRIEF DESCRIPTION OF THE DRAWING

The preferred embodiment of the present invention will be described in connection with the drawing, wherein.

DETAILED DESCRIPTION OF THE PREFERRED EMBODIMENT

Figure 1:
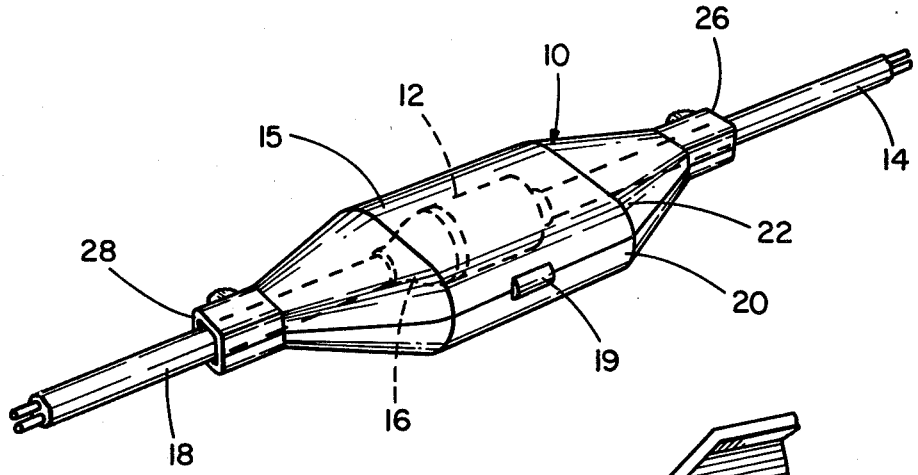
FIG. 1 is a perspective view of the preferred embodiment of the present invention.

Referring to FIG. 1, the socket and plug holder of the preferred embodiment includes a housing 10 for maintaining the electrical connection between a socket 12 of an electrical power cord 14 and a plug 16 of an electrical power cord 18. The housing 10 preferably has a lower section 20 and an upper section 22. The upper section 22 and the lower section 20 cooperate to define a space 15 for receiving the plug 16 and the socket 12. As desired, a variety of sizes and shapes of sockets 16 and plugs 12 may be received, at various times, in a single housing 10.

Figure 2:
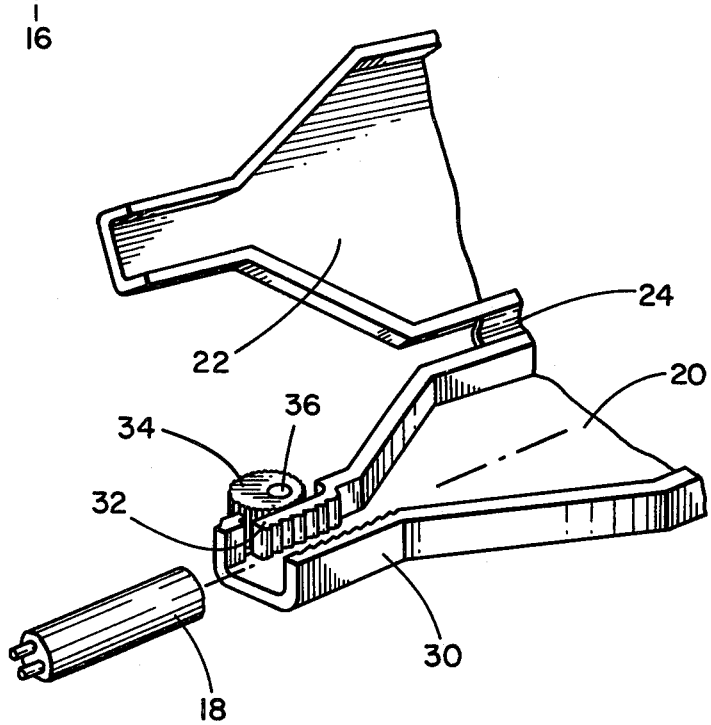
FIG. 2 is a partial perspective view of the preferred embodiment of FIG. 1, with the housing open.

As shown in FIG. 2, the sections 20,22 are hingedly connected by an integrally formed, flexible hinge section 24. A flexible clasp 19 on the upper section 22 cooperates with a catch (not shown) on the lower section 20 to releasably lock the section 20,22 in the locked position shown in FIG. 1.

Referring again to FIG. 1, the housing 10 further defines two openings 26 and 28 into the space 15 for receiving the socket 12 and the plug 16. When the housing 10 is opened as shown in FIG. 2, the socket 12 and plug 16 may be placed in the space 15 and the cords 14,18 may be passed through the openings 26,28, respectively.

Figure 3:
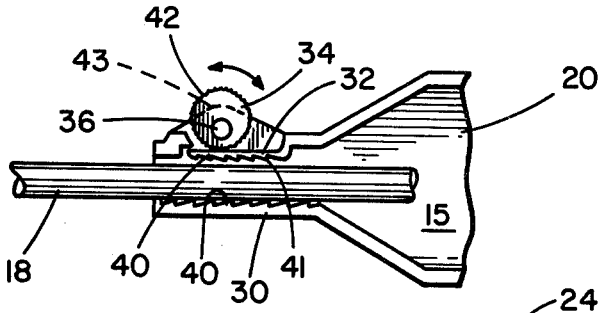
FIG. 3 is a partial, top plan view of the lower section of the housing of the preferred embodiment.
Figure 4:
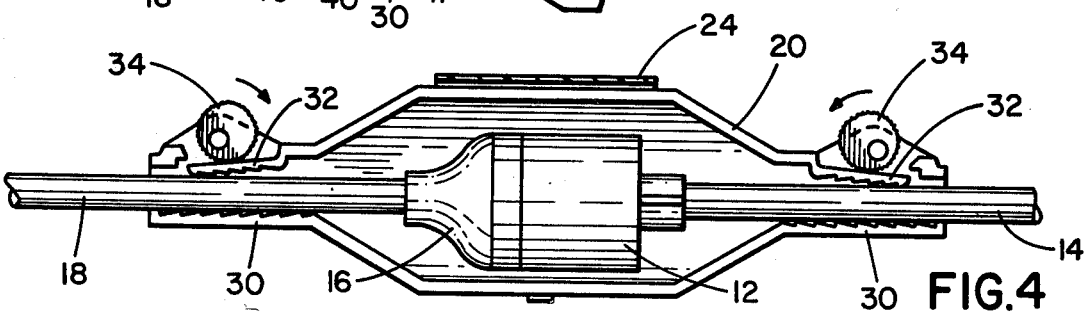
FIG. 4 is a top plan view similar to FIG. 3, depicting the eccentric cams of the preferred embodiment rotated to cause the jaws to grip the cord.

As shown in FIGS. 2–4, the housing 10 includes at least one and preferably two mechanisms for holding either cord 14,18 against tension in the cords. As detailed in FIG. 3, each mechanism for holding a cord includes a rigid jaw member 30 integrally molded with the lower section 20 of the housing 10, a flexible jaw member 32 integrally molded with the lower section 20 and an eccentric cam member 34 rotatably mounted on a peg 36 that is integrally molded atop a support surface 38 on the lower section 20. The rigid jaw member 30 and the flexible jaw member 32 are located opposite one another across the opening 28, and each includes a ridged section 40 along the opening 28. As shown, the ridges 41 of the ridged sections 40 are inclined inward toward the space 15.

The eccentric cam member 34 is located on the side of the flexible jaw member 32 away from the opening 28. The outer surface 42 of the eccentric cam member 34 is ridged with ridges 43 running in a direction parallel to the rotational axis defined by the peg 36. As shown by comparing FIGS. 3 and 4, the eccentric cam member 34 is rotatable between a position in which the flexible jaw member 32 is not flexed to a position in which the flexible jaw member 32 is flexed against the electrical cord 18.

The use of the holder is now described. The socket 12 and plug 16 are connected as is usual and placed in the lower section 20 of the housing 10, with the electric cords 14,18 passing through the openings 26,28. The upper section 22 may then be locked in the position shown in FIG. 1, and the eccentric cam members 34 rotated as shown in FIG. 4. In this position, the eccentric cam members 34 force the flexible jaw members 32 to the flexed position in which the electrical cords 14,18 are firmly gripped or clamped between the ridged sections 40 of the jaw members 32,30. Because the ridges 41 of the ridged sections 40 are inclined toward the space 15, the cords 14,18 are more effectively retained against tension in either cord 14,18. The ridges 43 on the outer surface 42 of the eccentric cam members 34 effectively hold the eccentric cam members 34 and the flexible jaw members 32 in the position shown in FIG. 4, until it is desired to remove the cords 14,18 from the housing 10.

As thus described, the socket and plug holder of the preferred embodiment satisfies the objects stated above, and also satisfies other objects and advantages. For example, the preferred embodiment is adaptable to hold a variety of sizes and shapes of plugs 16 and sockets 12, and a variety of sizes and shapes of electrical cords 14,18. Also, the preferred embodiment may be molded economically of plastic such as polyproplylene and assembled quickly and readily. As preferred, the eccentric cam member 34 is placed on the peg 36 and locked thereon by melting the top of the peg 36 to form a head over the eccentric cam member 34.

An additional advantage is that the holder will not only prevent physical damage to the cords 14,18 and the socket 12 and plug 16, but it will protect them from drips and splashes when used, for example, on construction sites. For the sake of safety on such construction sites, the holder is preferably molded in a bright yellow or orange color.

From the foregoing, it should be apparent to those having skill in the art that modifications or changes could be made in the construction of the socket and plug holder described in this application. Thus, the preferred embodiment of the present invention is intended to be illustrative and not restrictive. All changes which come within the meaning and range of equivalency of the claims are intended to be embraced therein.

What is claimed is:

1. A holder for maintaining an electrical connection between a socket of a first electrical cord and a plug of a second electrical cord, said holder comprising, in combination:

a housing having a lower section and an upper section hingedly attached thereto, said upper section and said lower section cooperatively defining a space for receiving said plug and socket and further defining two openings into said space for passage of said cords;

a rigid jaw member integrally molded on said housing adjacent one of said openings;

a flexible jaw member integrally molded on said housing adjacent said one opening and opposite said rigid jaw member, said flexible jaw member adapted to be flexed to a flexed position wherein one of said cords is clamped against movement thereof between said flexible jaw member and said rigid jaw member; and an eccentric cam member pivotably mounted on said housing adjacent said flexible jaw member on the side thereof opposite said one opening, said cam member being pivotable to a pivoted position wherein said cam member forces said flexible jaw member to said flexed position;

whereby said one cord is clamped against movement thereof and the electrical connection between said socket and said plug is maintained against tension in said one cord.

2. A holder as claimed in claim 1 wherein said rigid jaw member is a first rigid jaw member, said flexible jaw member is a first flexible jaw member and said eccentric cam member is a first eccentric cam member, said holder including a second rigid jaw member; a second flexible jaw member; and a second eccentric cam member;

said second rigid jaw member integrally molded on said housing adjacent the other of said openings;

said second flexible jaw member integrally molded on said housing adjacent said other of said openings and opposite said second rigid jaw member, said second flexible jaw member capable of flexing to a flexed position wherein the other of said cords is substantially retained against movement between said second flexible jaw member and said second rigid jaw member; and said second eccentric cam member pivotally mounted on said housing adjacent said second flexible jaw member on the side thereof opposite said other of said openings, said second cam member being pivotable to a pivoted position wherein said second cam member forces said second flexible jaw member to said flexed position;

whereby said other of said cords is retained against movement thereof and the electrical connection between said socket and plug is maintained against tension in said other of said cords.

3. A holder as claimed in claim 1 in which said flexible jaw member has a ridged section along said opening.

4. A holder as claimed in claim 1 in which said rigid jaw member has a ridged section along said opening.

5. A holder as claimed in claim 1 in which said flexible jaw member has a ridged section including ridges along said opening and said rigid jaw member a ridged section including ridges along said opening, said ridges of said ridged sections inclined toward said space.

6. A holder as claim in claim 1 in which said first cam member has a ridged cam surface for contacting said first jaw member.

* * * * *